US009079236B2

(12) United States Patent
Wallinder

(10) Patent No.: US 9,079,236 B2
(45) Date of Patent: Jul. 14, 2015

(54) BEAD ROLLER

(76) Inventor: Jonas Wallinder, Vreta kloster (SE)

( * ) Notice: Subject to any disclaimer, the term of this patent is extended or adjusted under 35 U.S.C. 154(b) by 549 days.

(21) Appl. No.: 13/348,060

(22) Filed: Jan. 11, 2012

(65) Prior Publication Data

US 2012/0304725 A1 Dec. 6, 2012

(30) Foreign Application Priority Data

Jun. 1, 2011 (SE) ..... 1100430

(51) Int. Cl.
*B21D 17/04* (2006.01)

(52) U.S. Cl.
CPC ..... *B21D 17/04* (2013.01)

(58) Field of Classification Search
CPC ..... B21D 17/04
USPC ..... 72/101, 105, 106, 176, 179, 180, 182, 72/116
See application file for complete search history.

(56) References Cited

U.S. PATENT DOCUMENTS 450,262 A * 4/1891 Southard et al. ..... 72/101
882,502 A * 3/1908 Janssen et al. ..... 72/101
1,486,736 A * 3/1924 Foster ..... 72/101
1,837,629 A * 12/1931 Newton ..... 72/179
2,182,401 A * 12/1939 Kreis et al. ..... 72/106
4,869,088 A * 9/1989 Kadotani ..... 72/106
6,591,651 B2 7/2003 Kutschker et al.

FOREIGN PATENT DOCUMENTS

EP 1518616 A2 9/2004

* cited by examiner

*Primary Examiner* — Shelley Self
*Assistant Examiner* — Pradeep C Battula
(74) *Attorney, Agent, or Firm* — Robert Platt Bell

(57) ABSTRACT

A bead roller sheet metal working machine having a first drive shaft and a second drive shaft arranged in a plane common to both drive shafts, wherein both drive shafts at their respective inner ends are driven by means of a drive unit which by a first transmission drives the drive shafts to rotate in opposite rotational directions, and where the drive shafts at their respective outer ends are equipped with dies by way of which the sheet can be provided with beads when the sheet is forwarded between the dies along a plane substantially tangential and common to both dies, and where a greater part of mutually facing surfaces of two arms carrying the drive shafts are located at a greater distance from one another than a distance between the outermost ends of the drive shafts to allow a curved work piece access to the machine while working.

18 Claims, 6 Drawing Sheets

BEAD ROLLER

CROSS-REFERENCE TO RELATED APPLICATIONS

The present application claims foreign priority from Swedish Application No. SE1100430-6 filed on Jun. 1, 2011, and incorporated herein by reference.

FIELD OF THE INVENTION

The present invention relates to a bead roller for use in connection with sheet metal working, where a thin sheet can be shaped and provided with beads by feeding the sheet between dies of the machine.

BACKGROUND OF THE INVENTION

Bead rollers are used in techniques for sheet metal shaping to achieve stiffening of sheets, to model a sheet metal to a desired structure or to design a sheet as desired. The stiffening or the design is accomplished by providing the sheet with profiles, such as beads in the form of notches, steps or ridges, which may be linear or curved as desired, along the sheet.

In the automotive industry there are a lot of sheet details which may have to be shaped into different designs. With regard to types of vehicles manufactured in series it is obvious to use pressing tools which model sheet details for a specific type of vehicle in a press, where sheets aimed for a specific location in the vehicle are stamped in a desired amount having identical designs or patterns. On the other hand, if vehicles like cars or motor bikes are manufactured in solitary numbers, it would be too costly to utilize a number of different presses to model different sheet details, for example details of the coach of a car, fenders of a motor bike, etc. In cases like that, where solitary details are to be shaped of sheets to constitute, for example, fenders, sides of doors, bonnets, lids or other details of a vehicle, a bead roller can be used to model the sheet to the stiffness, structure and design desired.

Bead rollers are known since long. Examples of such machines are disclosed in Published European Patent Application EP1518616 A2 and U.S. Pat. No. 6,591,651, both of which are incorporated herein by reference. The function of a known bead roller, exemplified by said documents is described in the following with reference to FIGS. 1, 2*a* and 2*b*.

FIG. 1 depicts a conventional Prior Art bead roller. Machine 101 is, in this case a model mounted to the floor by means of a floor stand 102. Further, machine 101 comprises two drive shafts 103 and 104 (FIGS. 2*a*, 2*b*) mounted in parallel. The ends of shafts 103 and 104 are adapted to receive different types of dies 105*a*, 105*b* (shown in FIGS. 2*a*, 2*b*) depending on the type of bead desired, on a sheet being fed between dies 105*a*, 105*b*. Drive shafts 103, 104 are journaled in bearings in respective arms 106, 107 and have their inner ends connected to respective gear wheels and transmission to a motor 108 for driving shafts 103 and 104. Arms 106, 107 are fixed to floor stand 102, usually in such a way that drive shafts 103 and 104 are parallel to the ground on which floor stand 102 is mounted. The drive of the shafts 103 and 104 is arranged so that the dies counter rotate and thereby feed a sheet plate contacting dies 105*a*, 105*b* from the upper and lower side, respectively, in a forward direction (normally away from an operator). On the upper arm 106, in this example, a screw 109 is mounted. By means of this screw 109, a desired pressure between dies 105*a*, 105*b* can be set.

Operation of the prior art bead roller is illustrated in FIGS. 2*a* and 2*b*. In these Figures, being principal outlines, drive shafts 103 and 104 and their mountings in bearings in the arms 106, 107 are shown more in detail. A sheet 110 and an ongoing shaping of sheet 110 are also visible. FIGS. 2*a* and 2*b* depict how a bead, in this case being a ridge along the sheet, is accomplished. For this purpose a first die 105*a* and a second die 105*b* are mounted on the outer end of the respective drive shafts 103, 104. The first die 105*a* is furnished with a circumferentially running sunk recess 111*a*, while the second die 105*b* is furnished with a circumferentially running ridge 111*b* corresponding to and matching the curvature of said recess 111*a*. As dies 105*a*, 105*b* are counter rotating with respect to each other when driven by shafts 103, 104, sheet 110 will be fed forward between dies 105*a*, 105*b* with a pressure is set as desired, whereby a bead will be shaped, in this case as a bead designed as a ridge extending a desired length across the sheet 110. By manually steering the sheet in different directions during the operation in a plane substantially tangentially with the two dies 105*a*, 105*b*, a desired curvature of the bead can be accomplished. The cross sectional profile of the bead is determined by the choice of the two matching dies 105*a*, 105*b*.

With reference to FIG. 3, it is illustrated how difficulties can occur during the described sheet working according to Prior Art. A simple embodiment of a bead roller according to conventional technology is depicted schematically, simplified and stereotyped in FIG. 3. According to FIG. 3, a bead, in this case a ridge elevated from the sheet surface along a curve in the middle of the exterior surface of a fender 110 of a motorbike is under preparation. As clearly disclosed by the figure it will be impracticable to achieve the desired bead in this case, as the restricted space between the two drive shafts 103, 104 prevents the introduction of one of the lengthwise edges 113 of the fender between the drive shafts 103, 104 of the machine due to the heavy bend in the fender cross section. FIG. 3 illustrates how the edges of the fender intersect deeply into the area 113, which needs to be freely available to carry out the described operation. In the case exemplified, drive shaft 104, and of course also a housing, for example the housing of an arm 106, surrounding drive shaft 104, block the desired actions on the maneuvering of the fender.

SUMMARY OF THE INVENTION

The present invention relates to a bead roller for sheet metal shaping.

One object of the invention is to arrive at an increased maneuverability and to obtain more working space when working with a sheet in the bead roller. This is achieved by making the area between the drive shafts larger than what has been prevailing with Prior Art machines of this kind. The increased area between the drive shafts is made possible by means of restructured the drive and a division of one or both of the drive shafts of the machine. The area between the drive shafts, in a plane common to both shafts, is limited by the edges constituted by the drive shafts and distances drawn between corresponding mountings at the ends of the drive shafts.

A substantial advantage of the present invention in relation to corresponding Prior Art machines is the increased maneuverability for work pieces when profile on a sheet plate work piece is to be carried out.

By the arrangement of a substantially greater maneuvering space between the drive shafts of the dies as described below, according to the present invention, possibilities to perform the sheet working on sheet work pieces having strong curvatures in a plane common to the plane through both drive shafts can be achieved. By this is meant that a drive shaft, as in a conventional arrangement, will not be a hindrance for the forwarding of said sheet work piece between the dies. Where profiles on sheets are to be effected, the inventive machine allows a substantially increased number of operations to be accomplished compared to what has been possible by use of current and conventional bead rollers.

The inventive bead roller is characterized by that the major part of the surfaces of the two arms facing each other and enclosing the drive shafts driving the dies are located at a greater distance from each other than the distance between the outermost ends of the drive shafts. It should be noted here that the term: "the outermost ends of the drive shafts" refers to the ends on which dies are mounted. Further, by said distance is meant the shortest distance between the surfaces of the drive shafts at said outermost ends.

DETAILED DESCRIPTION OF THE INVENTION

Below, a number of variants of embodiments of the invention are described and supported by the accompanying Figures.

Figure 4:
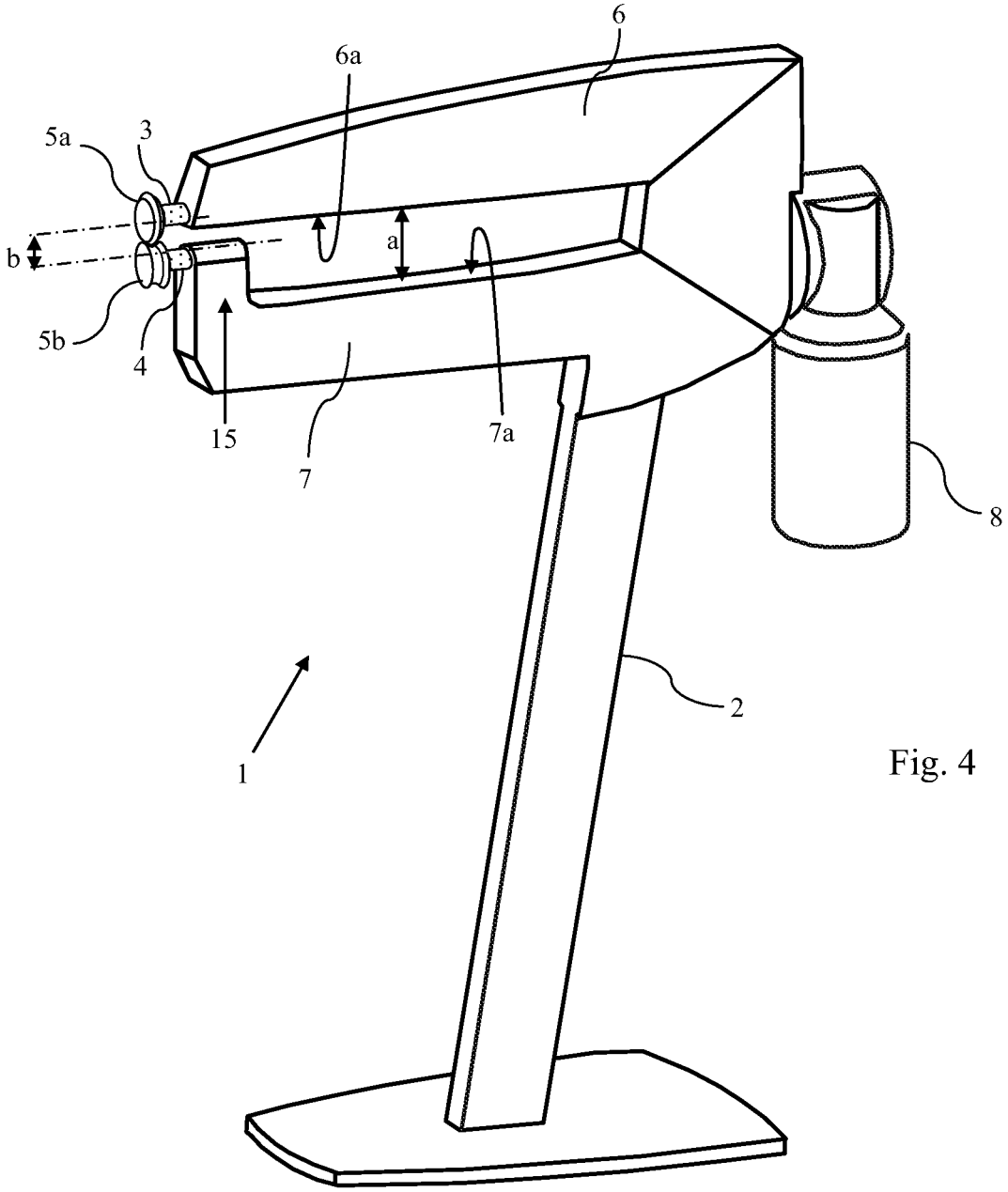
FIG. 4 is a perspective view of a floor model of the bead roller according to the invention.

FIG. 4 is a perspective view of a floor model of a bead roller 1 according to a first embodiment of the present invention. It should here, furthermore, be mentioned that details having correspondence to details of prior art designs of bead rollers, as described above, are referred to by use of the same final Figures, but details for the Prior Art machines being numbered starting from reference number 101 to avoid confusion. From the Figure it is evident that a floor stand is denoted by 2. Upper and lower arms are denoted by 6 and 7, respectively. Drive shafts 3, 4 are supported by, usually enclosed by and carried in bearings by the arms 6, 7, where said drive shafts 3, 4 are located in a plane common to both drive shafts in a manner as described below. A drive unit 8, here represented by an electric motor, is utilized to run the drive shafts. Instead of the use of an electric motor, other types of drive units 8 may be utilized. Simpler machines may, for example, use a crank for manual drive. A feature, outstanding for bead roller 1 according to the invention, is constituted by the increased working area between the drive shafts, i.e., the area where sheet working takes place, as represented in FIG. 4 by the area overrun by arrow a when arrow a is moved along and between arms 6 and 7. The increased working area is related to and compared to the corresponding working area at conventional bead rollers, so far as it is already from the example depicted in FIG. 4 evident that one of the drive shafts 3, 4 is divided to render the increased area possible. The term: "area" is directed to the available free area between the two arms 6, 7 denoted by arrow a.

The arms 6 and 7 are made up of housings surrounding the drive shafts 3, 4 and at the same time serving as shields around these drive shafts. According to the inventive example of a bead roller having said arms 6, 7 enclosing drive shafts 3, 4 for dies 5*a*, 5*b*, as depicted in FIG. 4, a major part of the surfaces 6*a* and 7*a* of the two arms 6, 7 facing each other are located at a greater distance a from each other than the distance b between the outermost ends of the drive shafts 3, 4. By the outermost ends means the ends which can be provided with dies 5*a*, 5*b*.

Figure 5A:
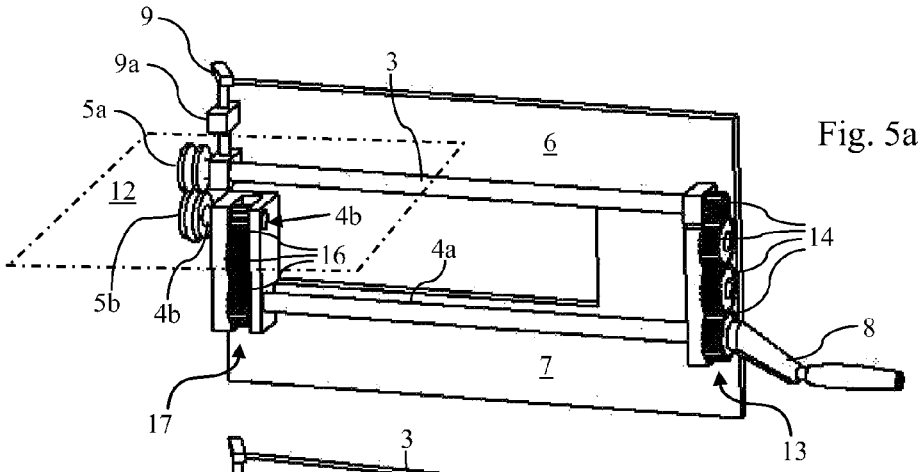
FIG. 5*a* is a perspective view of one embodiment of the present invention opened to show the rear wall of a housing around the respective drive shaft and which illustrates the drive shafts and a gear drive according to one embodiments of the present invention.
Figure 5B:
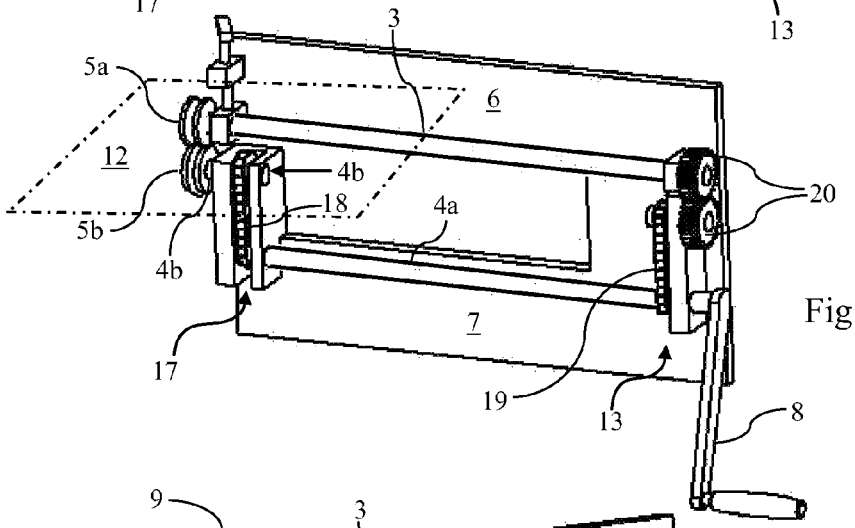
FIG. 5*b* is a perspective view of one embodiment of the present invention opened to show the rear wall of a housing around the respective drive shaft and which illustrates the drive shafts and a chain drive according to one embodiment of the present invention.
Figure 5C:
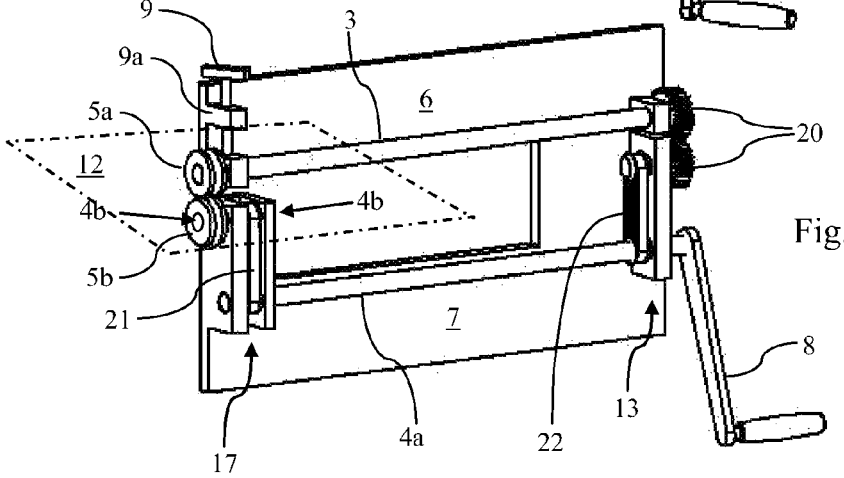
FIG. 5*c* is a perspective view of one embodiment of the present invention opened to show the rear wall of a housing around the respective drive shaft and which illustrates the drive shafts and a belt drive according to one embodiments of the present invention.

Arrangements to accomplish the stated structure are illustrated in FIGS. 5*a-c*, where a number of variants for drive shaft configurations are described and illustrated. If a machine according to the invention were manufactured without a protecting housing, the surfaces facing each other of the parts of the drive shafts 3, 4 moved apart (moved apart—as compared to conventional bead rollers) shall themselves be regarded as and be equalized to the surfaces 6*a*, 7*a* of a machine provided with a housing. In such a case, the distance a shall be looked upon as the mean distance between the major parts of the drive shafts 3, 4, which at its ends can be provided with dies.

FIGS. 5*a* to 5*c* illustrate various embodiments where one of the drive shafts is divided. FIGS. 5*a*-5*c* illustrate that, in these cases, the upper drive shaft 3 may be retained as an undivided drive shaft, while on the other hand the lower drive shaft 4 may be divided into one longer part 4*a* and one shorter part 4*b*. Only the variant with the lower drive shaft being parted is shown, but nothing prevents that the embodiment be made inverted, i.e. that the upper drive shaft 3 is the divided drive shaft, while the lower drive shaft 4 is preserved as undivided. When use of such alternative embodiments, which are not described here, but easily perceived, such an inverted embodiment entails that the reference FIG. 4 is amended to 3 and vice versa in all descriptions of embodiments according to FIGS. 5*a*-5*c*. Embodiments with a divided drive shaft 4*a*, 4*b* entail, according to the invention, that the shorter part 4*b* is mounted in bearings in the outer part of the lower arm 7. FIGS. 5*a-c* and the following Figures are perspective drawings with the outer cover removed for clarity, and thus only illustrate the rear part of a wall which constitutes a part of the arm encapsulating and supporting drive shafts 3 and 4 or the corresponding divided parts 3*a*, 3*b* and 4*a*, 4*b* of drive shafts 3, 4.

The bead roller embodiment according to FIG. 5*a* illustrates a variant where the parted drive shaft 4*a*, 4*b* is run by means of a drive unit 8 which by way of a first transmission 13 transfers rotational motion to both drive shafts 3, 4. The first transmission 13 has to be arranged so that both drive shafts 3, 4 are rotated in opposite rotational directions to force a forward longitudinal movement of a sheet introduced between the dies 5*a*, 5*b* mounted on the outermost ends of the drive shafts. In the Figures depicting the invention, a screw, by means of which the bearing pressure between upper 3 and lower 4 drive shafts can be regulated as denoted by reference numeral 9. Screw 9 extends through a thread in a dog 9*a*, which is fixed in upper arm 6, whereby a pressure against the lower drive shaft 4 with respect to arm 6 may be regulated. In FIGS. 5*a* and the following Figures, a working plane 12 is shown between the upper die 5*a* and the lower die 5*b*. Said working plane extends tangentially to both the upper 5*a* and the lower 5*b* die and will thus be substantially perpendicularly oriented to a plane through and common to both drive shafts 3, 4. The sheet which is to be treated will also, at least in the area between the dies, coincide with the herein referred to as the working plan 12 during the sheet working.

Figure 1:
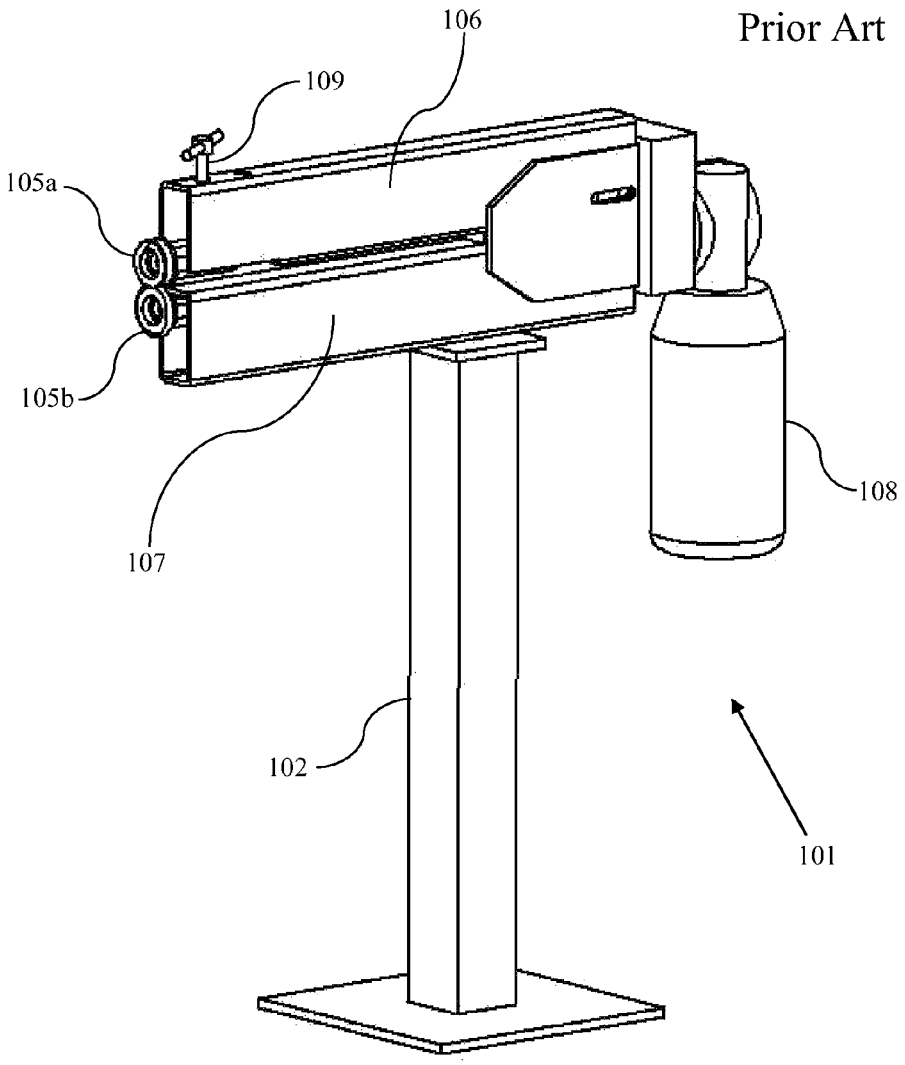
FIG. 1 is a perspective view illustrating a Prior Art bead roller being of a floor-mounted version with two arms for drive shafts.
Figure 2A:
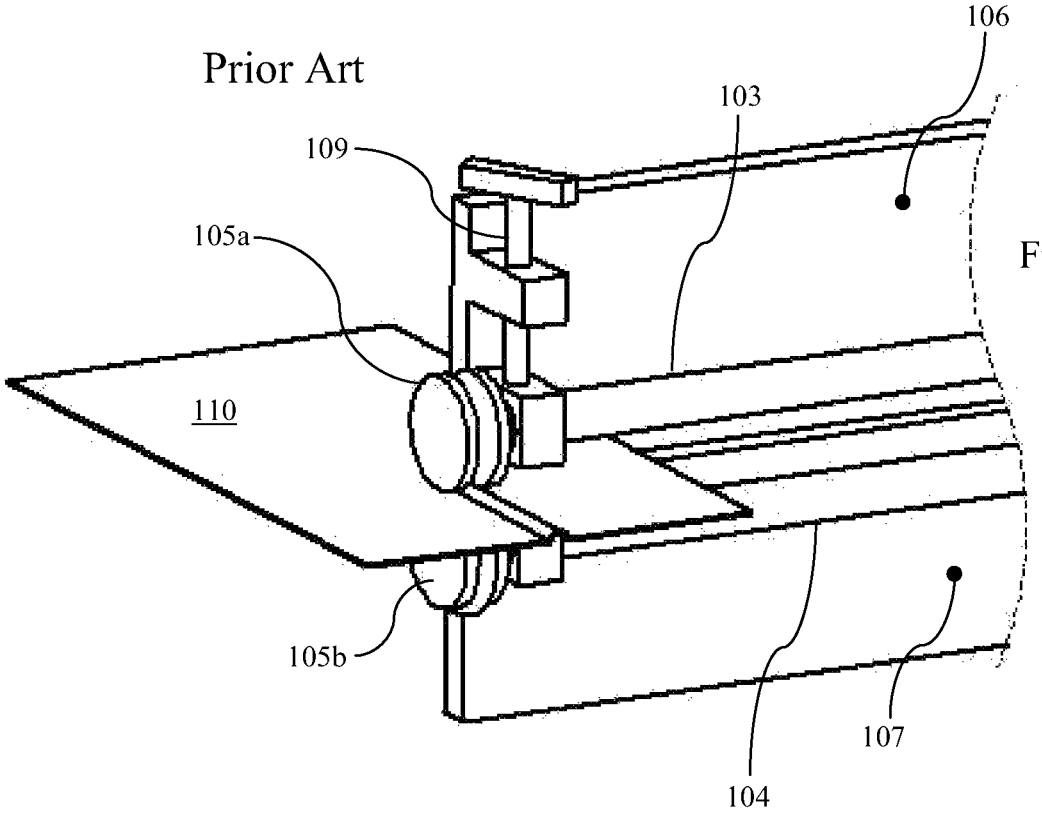
FIG. 2*a* is a first perspective view of the Prior Art bead roller according to FIG. 1, illustrating the drive shafts and their bearing in the arms of the machine.
Figure 2B:
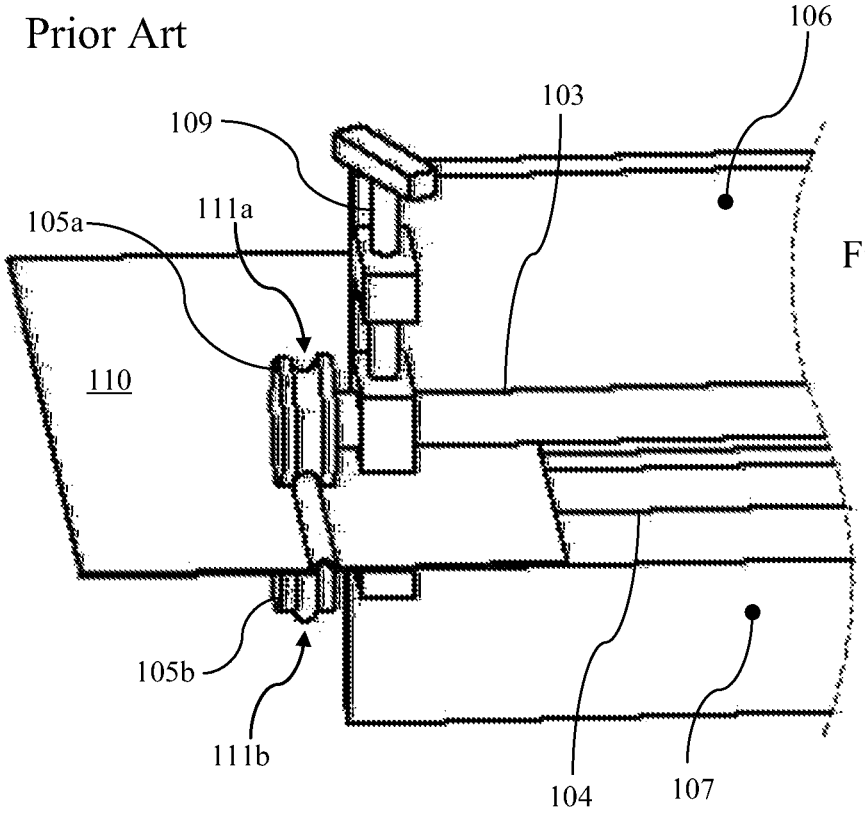
FIG. 2*b* is a second perspective view of the Prior Art bead roller according to FIG. 1, illustrating the drive shafts and their bearing in the arms of the machine.
Figure 3:
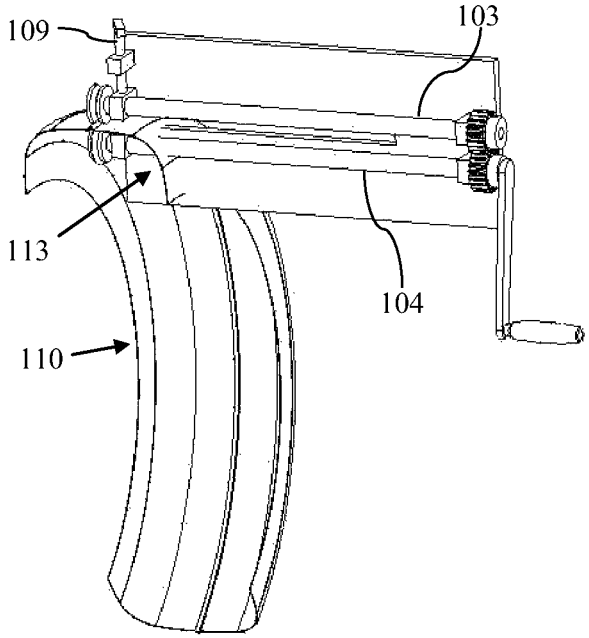
Prior Art Fig. 3
FIG. 3 is a perspective view of a Prior Art bead roller, illustrating by means of an outline view, the impossibility to handle certain types of work pieces during sheet shaping work in the Prior Art bead roller.
Figure 6:
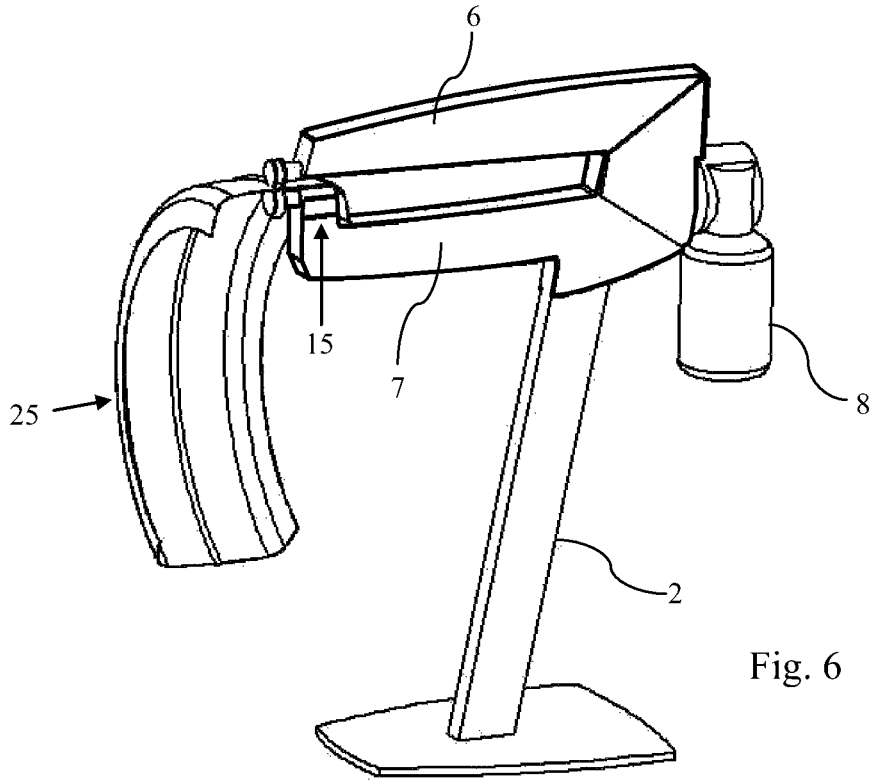
FIG. 6 schematically shows a bead roller according to the invention being used in sheet working exemplified by means of shaping a work piece having great bends.

FIG. 5*a* illustrates the division of one shaft, in this case the lower shaft 4, achieved through an extension of the first transmission in height and being realized by means of a number of gear wheels 14 arranged in a row and further in such a way that the two drive shafts 3, 4 are rotated in opposite rotational directions. The longer part 4*a* of the lower drive shaft 4 is run directly by drive unit 8 and the drive of the upper drive shaft 3 is achieved by means of a desired number of gear wheels 14, which brings about the drive of the lower shaft 4 to the upper shaft 3. Through this measure the longer part 4*a* of the lower shaft 4 may be moved in a parallel displacement away from the working plane 12 common to the dies. The outer end of the longer part 4*a* of the lower shaft 4 is mounted in bearings of a gear box 15, as illustrated in FIGS. 4 and 6. The shorter part 4*b* of the lower drive shaft 3 is mounted in bearings in the upper end of the gear box 15. Said shorter part 4*b* is further, within the gear box 15 provided with gear wheels 16, which serve as a second transmission 17 transferring power from the longer part 4*a* to the shorter part 4*b* of the lower drive shaft 4.

FIG. 5*b* depicts an alternative embodiment of a bead roller 1, where the configuration of the machine in principle is the same as the one described in connection with FIG. 5*a*, but here a variant of the first 13 and second transmission 17 is shown. In this embodiment, instead of using a gear wheel, a chain drive 18 is utilized at the second transmission 17 for the power transfer from the longer part 4*a* of the lower drive shaft 4 to the shorter part 4*b* of the lower drive shaft 4. A corresponding chain drive 19 at the first transmission 13 transfers rotational motion to a second gear wheel 20 arranged to establish the counter rotational motion of the upper drive shaft 3.

FIG. 5*c* illustrates a further embodiment of a bead roller, whereby also in this case the configuration of the machine in principle is the same as in FIGS. 5*a* and 5*b*. As an alternative, a variant of the first 13 and second 17 transmissions is shown. Instead of using gear wheels, a drive belt 21 is used in this case at the second transmission 17 for the transfer of power from the longer part 4*a* of the lower drive shaft 4 to the shorter part 4*b* of the lower drive shaft 4, whereby the drive belt 13 brings about rotational motion from the longer to the shorter part of drive shaft 4. A corresponding drive belt 22 at the first transmission 13 transfers rotational motion to a second gear wheel 20 arranged to establish the counter rotational movement of the upper drive shaft 3.

There is, of course, nothing that prevents the use of a mix of transfers of power from the first 13 to the second 17 transmission, which means that a drive by means of teeth, chain or drive belt may be selected for the respective transmission 13 and 17. As a further alternative a V-belt could be used instead of a drive belt. As a drive shaft easily could slip at heavy load on the drive shaft the solutions listed are preferred.

One advantage with the present invention in relation to prior art is illustrated and easily understood according to FIG. 6. FIG. 6 illustrates how a bead in the shape of a ridge is prepared through a sheet shaping on a motorcycle fender 25. Here, it is obvious that the heavy bend of the fender in the plane of the drive shafts 3, 4 does not give rise to any problems during the work with the sheet. This has been accomplished as the distance between the two arms 6, 7 behind the gear box 15 has been arranged to be so great that bent sheets can easily be handled and worked with. It is further obvious from FIG. 6 that it is advantageous to make the gear box 15 as thin as possible in the axial direction. By designing the gear box 15 to be thin, i.e. the closer its inner wall is arranged to the dies 5*a*, 5*b*, the bigger the radii of curvature of the sheet being prepared may be allowed. The choice of drive according to FIGS. 5*a* to 5*c* has impact on the width of the gear box 15 in the axial direction.

Figure 7:
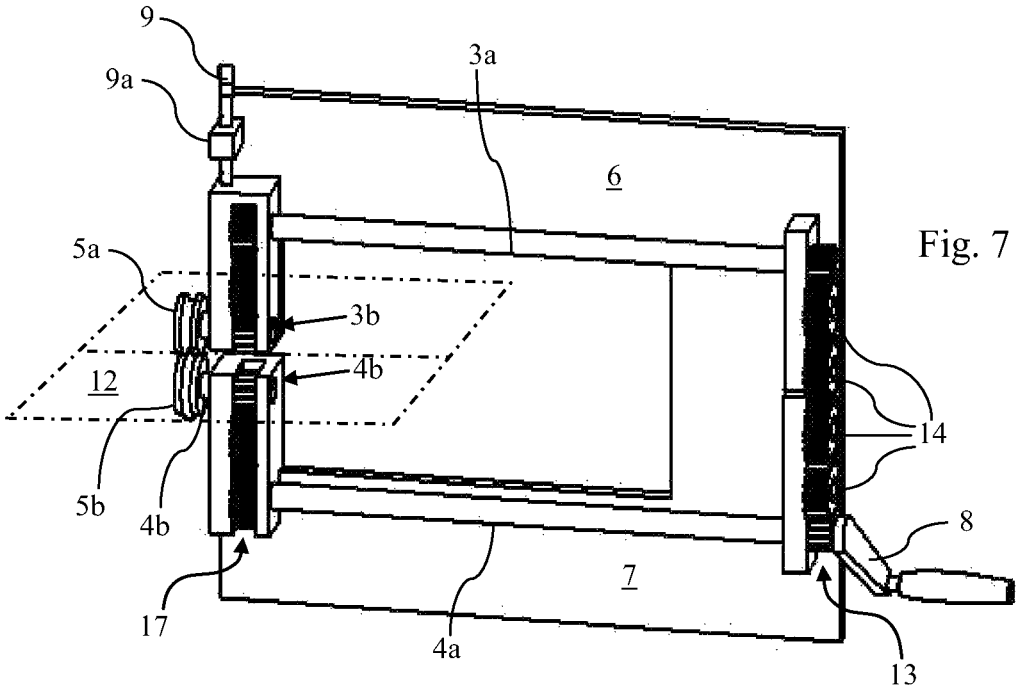
FIG. 7 is a perspective view of the same type as in FIG. 6, illustrating a variant of the bead roller according to the present invention, where both drive shafts are divided to arrive at a larger working space between the drive shafts.

As shown in FIG. 7 both shafts 3 and 4 of the bead roller 1 may be divided and displaced in parallel away from each other and thus give a possibility to an even larger open area between the arms 6, 7 housing the drive shafts 3 and 4. By this, sheets which have bends both upwards and downwards in its cross section can be handled in the machine according to the invention. The drive of both the divided shafts is hereby accomplished according to any one of the alternatives disclosed and illustrated in FIGS. 5*a* to 5*c*. The second transmission 17 may then be provided in duplicate at the outer ends of the shafts and bring about rotational motion from the longer part 3*a* to the shorter part 3*b* of the upper drive shaft 3. The first transmission 13 may simply be made extended and, as previously discussed, takes care of the transfer of rotational motion from drive unit 8 to both drive shafts 3, 4.

Figure 8:
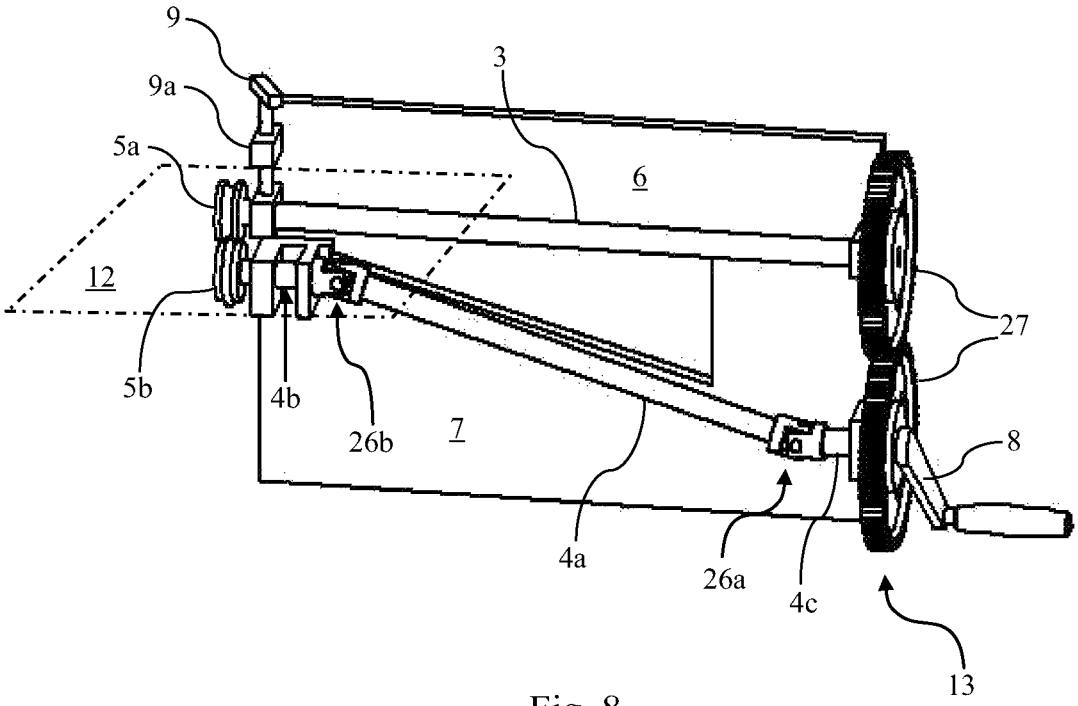
FIG. 8 is a perspective view of the same type as in FIG. 7, illustrating a variant of the bead roller of the present invention by implementing a division of at least one drive shaft of the bead roller according to the invention, where the division of a drive shaft is performed by means of universal joints between the parts of the drive shafts.

Still an alternative of an embodiment of the bead roller 1 according to the invention is illustrated in FIG. 8. Here, the lower drive shaft 4*a* has been divided in three parts, a longest part 4*a*, a shorter part 4*b* to which one a die can be attached and a third part 4*c* being connected to the first transmission 13. The different parts are coupled to each other by means of universal joints 26*a*, 26*b*. The drive from a drive unit 8 is effected by way of the first transmission 13 to the third part 4*c* of drive shaft 4 being connected to the first transmission. The drive is further transferred by means of the first universal joint 26*a* to the longest part 4*a* of drive shaft 4, still further through the second universal joint 26*b* to the part 4*b* of the lower drive shaft 4 carrying the die. In this case the part 4*b* carrying the die will be mounted in bearing in parallel with and close to the upper drive shaft 3 in a bearing in gear box 15 as previously disclosed. As a result, the longest part 4*a* of the drive shaft may be inclined away from the tangential plane 12 common to both dies 5*a*, 5*b*. In this way the space between the drive shafts for maneuvering a sheet during work in said space may be increased deeper into the machine, compared to what is possible by use of prior art machines. The first transmission 13 may transfer rotational motion from the drive unit 8 to both drive shafts 3, 4 by means of gear wheels 27, whereby the third part 4*c* of drive shaft 4 connected to the first transmission 13 is coupled to one of said gear wheels 27 of first transmission 13.

In a way corresponding to the division of the lower drive shaft 4, alternatives may be implemented, whereas the upper drive shaft 3, or both lower 4 and upper 3 drive shaft may be divided and be driven by use of universal joints 26*a*, 26*b* as just described above with respect to one drive shaft. The division of the upper drive shaft 3 and the universal joint drive of this shaft correspond to the just described universal joint drive of the lower drive shaft 4. If both drive shafts are provided with universal joint drive in the way as described more than two gear wheels 27 may be needed in the first transmission 13.

The bearing for the shorter part 4*b* in the gear box 15, as well as the bearing for the part 3*b* of upper shaft 3 provided with a die in arm 7, are arranged at a distance from each other so that the dies 5*a*, 5*b* designed to be attached on the outermost ends of drive shafts 3, 4 will abut each other.

An alternative to the embodiments as disclosed above is to use an inclined drive shaft having, in principle, the same inclination as the longest part of the drive shaft shown in the embodiments utilizing universal joints (FIG. 5*c*). The inclined drive shaft 3, 4 is then mounted in bearings at the first transmission 13 and at the second transmission 17. According to this variant the drive shaft 3, 4 is run by means of a gear wheel at the drive unit 8. Said gear wheel at the drive unit transfers rotational motion to the drive shaft 3, 4 through a conical gear wheel mounted on drive shaft 3, 4. At the second transmission the drive shaft 3, 4 transfers, in turn, rotational motion to the shorter part of drive shaft 3, 4 by means of a conically shaped gear wheel at the outer end of the inclined longer part of drive shaft 3, 4. The shorter part of drive shaft 3, 4 is mounted in bearing in the same way as in the example shown in FIG. 5*a*. Also in this embodiment, one or both arms 6, 7 can be provided with this type of power transfer, i.e. an inclined shaft may be mounted in bearings at both transmissions 13, 17.

While the preferred embodiment and various alternative embodiments of the invention have been disclosed and described in detail herein, it may be apparent to those skilled in the art that various changes in form and detail may be made therein without departing from the spirit and scope thereof.

I claim:

1. A machine for shaping a sheet, where the machine comprises:

a first drive shaft having an inner end and an outer end;

a second drive shaft, having an inner end and an outer end, the second drive shaft arranged in a common plane with the first drive shaft;

a drive unit, coupled to both the first drive shaft and the second drive shaft at their respective inner ends, the driving unit comprising a first transmission at the inner end, to run said first drive shaft and said second drive shaft to rotate in opposite rotational directions;

a first die and a second die, respectively coupled to said first drive shaft and said second drive shaft in their respective outer ends, the first and second dies formed with a profile, such that when the sheet is forwarded between the first and second dies in a plane tangential and common to the dies, a profile is formed in the sheet;

wherein two arms enclosing the first and second drive shafts define a working area between said first and second drive shafts, said arms having surfaces facing each other and the greater part of said surfaces facing each other being located at a greater distance (a) from each other than a distance (b) between the outermost ends of the drive shafts to allow additional space for the sheet to access to the machine while working inside said working area, and wherein at least one of the first and second drive shafts is divided into a longer part and a shorter part where the longer part of said at least one first and second drive shafts is arranged such that the longer part of said divided drive shaft is arranged in parallel with said plane tangential and common to the dies at a greater distance from said plane tangential and common to the dies than the shorter part of said divided drive shaft, and said die being mounted on said shorter part of the drive shaft.

2. The machine according to claim 1, wherein a second transmission is provided in a gear box, in which the shorter part of the drive shaft is mounted in bearings in parallel with the plane tangential and common to the dies.

3. The machine according to claim 2, wherein the second transmission is arranged to transfer rotational movement from the longer part of the drive shaft to the shorter part of the drive shaft, wherein said second transmission comprises one of a series of gear wheels, a chain, and a drive belt.

4. The machine according to claim 3, wherein the first transmission transfers rotational movement from the drive unit to both drive shafts wherein said first transmission comprises one of a series of gear wheels, a chain in combination with a gear wheel, a drive belt in combination with a gear wheel.

5. The machine according to claim 2, wherein the first transmission transfers rotational movement from the drive unit to both drive shafts wherein said first transmission comprises one of a series of gear wheels, a chain in combination with a gear wheel, and a drive belt in combination with a gear wheel.

6. The machine according to claim 1, wherein the shorter part of the drive shaft is mounted in bearings in parallel with the plane tangential and common to the dies.

7. The machine according to claim 6, wherein the first transmission transfers rotational movement from the drive unit to both drive shafts be means of gear wheels, whereby a transmission coupled drive shaft part is connected to one of said gear wheels.

8. The machine according to claim 1, wherein the first transmission transfers rotational movement from the drive unit to both drive shafts, the first transmission comprising one or more of a series of gear wheels, a chain in combination with a gear wheel, and a drive belt in combination with a gear wheel.

9. The machine according to claim 1, wherein an adjustment screw is provided for setting the pressure between the dies attached to the ends of the drive shafts; said setting screw being arranged on at least one of the arms of the machine.

10. A machine for shaping a sheet, where the machine comprises:

a first drive shaft having an inner end and an outer end;

a second drive shaft, having an inner end and an outer end, the second drive shaft arranged in a common plane with the first drive shaft and parallel to the first drive shaft;

a third drive shaft, shorter than the second drive shaft, having an inner end and an outer end, arranged in a common plane with the first and second drive shafts and parallel to the first and second drive shafts, and being located between the first and second drive shafts, such that the first and second drive shafts are spaced apart to allow a curved portion of the sheet being shaped to reside between the first and second drive shafts, the third drive shaft arranged at the outer end of the second drive shaft and coupled mechanically to the second drive shaft, so as to rotate with the second drive shaft;

a first drive unit, coupled to both the first drive shaft and the second drive shaft at their respective inner ends, the drive unit comprising a first transmission at the inner end, to run said first drive shaft and said second drive shaft to rotate relative to one another;

a second transmission, coupled to the outer end of the second drive shaft and the inner end of the third drive shaft, to run said third drive shaft and said second drive shaft to rotate relative to one another, such that the third drive shaft and the first drive shaft rotate in opposite directions at the same rotational speed;

a first die and a second die, respectively coupled to the outer end of said first drive shaft and the outer end of the third drive shaft, the first and second dies formed with a profile, such that when the sheet is forwarded between the first and second dies in a plane substantially tangential and common to the dies, a profile is formed in the sheet;

wherein two arms enclosing the first and second drive shafts define a working area between said first and second drive shafts, said arms having surfaces facing each other and the greater part of said surfaces facing each other being located at a greater distance from each other than a distance between the outermost ends of the drive shafts to allow additional space for the sheet to access to the machine while working inside said working area.

11. The machine according to claim 10, wherein the first transmission transfers rotational movement from the drive unit to the first and second drive shafts, the first transmission comprising one or more of a series of gear wheels, a chain in combination with a gear wheel, and a drive belt in combination with a gear wheel.

12. The machine according to claim 10, wherein the second transmission transfers rotational movement from the second drive shaft to the third drive shaft, the second transmission comprising one or more of a series of gear wheels, a chain in combination with a gear wheel, and a drive belt in combination with a gear wheel.

13. The machine according to claim 10, wherein an adjustment screw is provided for setting the pressure between the dies attached to the ends of the drive shafts; said setting screw being arranged on at least one of the arms of the machine.

14. A machine for shaping a sheet, where the machine comprises:

a first drive shaft having an inner end and an outer end;

a second drive shaft, having an inner end and an outer end, the second drive shaft arranged in a common plane with the first drive shaft and parallel to the first drive shaft;

a third drive shaft, shorter than the second drive shaft, having an inner end and an outer end, arranged in a common plane with the first and second drive shafts and parallel to the first and second drive shafts and being located between the first and second drive shafts, such that the first and second drive shafts are spaced apart to allow a curved portion of the sheet being shaped to reside between the first and second drive shafts, the third drive shaft arranged at the outer end of the second drive shaft and coupled mechanically to the second drive shaft, so as to rotate with the second drive shaft;

a fourth drive shaft, shorter than the second drive shaft, having an inner end and an outer end, arranged in a common plane with the first and second drive shafts and parallel to the first and second drive shafts and being located between the first and second drive shafts, such that the first and second drive shafts are spaced apart to allow a curved portion of the sheet being shaped to reside between the first and second drive shafts, the fourth drive shaft arranged at the outer end of the first drive shaft and coupled mechanically to the first drive shaft, so as to rotate with the first drive shaft;

a first drive unit, coupled to both the first drive shaft and the second drive shaft at their respective inner ends, the drive unit comprising a first transmission at the inner end, to run said first drive shaft and said second drive shaft to rotate relative to one another;

a second transmission, coupled to the outer end of the second drive shaft and the inner end of the third drive shaft, to run said third drive shaft and said second drive shaft to rotate relative to one another;

a third transmission, coupled to the outer end of the first drive shaft and the inner end of the fourth drive shaft, to run said fourth drive shaft and said first drive shaft to rotate relative to one another, such that the fourth drive shaft and the third drive shaft rotate in opposite directions at the same rotational speed;

a first die and a second die, respectively coupled to the outer end of said fourth drive shaft and the outer end of the third drive shaft, the first and second dies formed with a profile, such that when the sheet is forwarded between the first and second dies in a plane substantially tangential and common to the dies, a profile is formed in the sheet;

wherein two arms enclosing the first and second drive shafts define a working area between said first and second drive shafts, said arms having surfaces facing each other and the greater part of said surfaces facing each other being located at a greater distance from each other than a distance between the outermost ends of the drive shafts to allow additional space for the sheet to access to the machine while working inside said working area.

15. The machine according to claim 14, wherein the first transmission transfers rotational movement from the drive unit to the first and second drive shafts, the first transmission comprising one or more of a series of gear wheels, a chain in combination with a gear wheel, and a drive belt in combination with a gear wheel.

16. The machine according to claim 14, wherein the second transmission transfers rotational movement from the second drive shaft to the third drive shaft, the second transmission comprising one or more of a series of gear wheels, a chain in combination with a gear wheel, and a drive belt in combination with a gear wheel.

17. The machine according to claim 14, wherein the third transmission transfers rotational movement from the first drive shaft to the fourth drive shaft, the third transmission comprising one or more of a series of gear wheels, a chain in combination with a gear wheel, and a drive belt in combination with a gear wheel.

18. The machine according to claim 14, wherein an adjustment screw is provided for setting the pressure between the dies attached to the ends of the drive shafts; said setting screw being arranged on at least one of the arms of the machine.

* * * * *